US007070395B2

(12) United States Patent
Lee et al.

(10) Patent No.: US 7,070,395 B2
(45) Date of Patent: Jul. 4, 2006

(54) VARIABLE CAPACITY ROTARY COMPRESSOR

(75) Inventors: In Ju Lee, Yongin (KR); Sung Hea Cho, Suwon (KR); Seung Kap Lee, Suwon (KR); Cheol Woo Kim, Seongnam (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 253 days.

(21) Appl. No.: 10/832,348

(22) Filed: Apr. 27, 2004

(65) Prior Publication Data

US 2005/0019193 A1 Jan. 27, 2005

(30) Foreign Application Priority Data

Jul. 23, 2003 (KR) ..... 10-2003-0050696

(51) Int. Cl.
*F04B 49/00* (2006.01)

(52) U.S. Cl. ..... 417/218; 417/221; 417/223; 417/410.3; 418/29; 418/60; 418/178; 148/639

(58) Field of Classification Search ..... 417/218, 417/221, 223, 410.3; 418/23, 29, 60, 63, 418/178; 148/639, 902
See application file for complete search history.

(56) References Cited

U.S. PATENT DOCUMENTS 713,301 A * 11/1902 Hagerty ..... 418/105
1,789,842 A * 1/1931 Rolaff ..... 418/63
4,397,618 A * 8/1983 Stenzel ..... 418/23
4,508,680 A * 4/1985 Niino et al. ..... 419/5
5,115,077 A * 5/1992 Matsuo et al. ..... 528/125
5,871,342 A 2/1999 Harte et al.
6,531,000 B1 * 3/2003 Takemura et al. ..... 148/286
6,860,724 B1 3/2005 Cho et al.

FOREIGN PATENT DOCUMENTS

GB 2140089 A * 11/1984 ..... 418/178
JP 01142282 A * 6/1989 ..... 417/312

* cited by examiner

*Primary Examiner*—Theresa Trieu
(74) *Attorney, Agent, or Firm*—Staas & Halsey LLP

(57) ABSTRACT

A variable capacity rotary compressor to prevent an eccentric bush and a locking pin from being deformed or worn out due to a variance in a pressure of a compression chamber as a rotating shaft rotates. The compressor includes upper and lower compression chambers having different interior capacities thereof, and a rotating shaft. Upper and lower eccentric cams are provided on the rotating shaft to be eccentric from the rotating shaft in a common direction. Upper and lower eccentric bushes are fitted over the upper and lower eccentric cams, respectively, with a slot provided at a position between the upper and lower eccentric bushes. The locking pin operates to change a position of the upper or lower eccentric bush to a maximum eccentric position. Further, surfaces of parts around first and second ends of the slot are heat-treated, thus increasing a hardness thereof.

24 Claims, 8 Drawing Sheets

VARIABLE CAPACITY ROTARY COMPRESSOR

CROSS-REFERENCE TO RELATED APPLICATION

This application claims the benefit of Korean Application No. 2003-50696, filed Jul. 23, 2003, in the Korean Intellectual Property Office, the disclosure of which is incorporated herein by reference.

BACKGROUND OF THE INVENTION

1. Field of the Invention

The present invention relates, in general, to rotary compressors and, more particularly, to a variable capacity rotary compressor, which is designed such that a compression operation is executed in either of two compression chambers having different capacities thereof, by an eccentric unit mounted to a rotating shaft.

2. Description of the Related Art

Generally, a compressor is installed in refrigeration systems, such as air conditioners and refrigerators, which operate to cool air in a given space using a refrigeration cycle. In refrigeration systems, the compressor operates to compress a refrigerant which circulates through a refrigeration circuit. A cooling capacity of the refrigeration system is determined according to a compression capacity of the compressor. Thus, when the compressor is designed to vary a compression capacity thereof as desired, the refrigeration system operates under an optimum condition considering several factors, such as a difference between a practical temperature and a predetermined temperature, thus, allowing air in the given space to be efficiently cooled, and saving energy.

A variety of compressors are used in the refrigeration systems. The compressors are typically classified into two types (i.e., rotary compressors and reciprocating compressors). The present invention relates to the rotary compressor, which will be described in the following.

The conventional rotary compressor includes a hermetic casing, with a stator and a rotor being installed in the hermetic casing. A rotating shaft penetrates through the rotor. An eccentric cam is integrally provided on an outer surface of the rotating shaft. A roller is provided in a compression chamber to be fitted over the eccentric cam.

The rotary compressor constructed as described above is operated as follows. As the rotating shaft rotates, the eccentric cam and the roller execute an eccentric rotation in the compression chamber. A gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, it is an aspect of the present invention to provide a rotary compressor which is constructed so that a compression operation is executed in either of two compression chambers having different capacities thereof by an eccentric unit mounted to a rotating shaft, thus varying a compression capacity as desired.

It is another aspect to provide a variable capacity rotary compressor, which is designed to prevent an eccentric bush and a locking pin from being deformed or worn out, even when the locking pin collides with the eccentric bush in a specific range due to a variance in a pressure of a compression chamber as a rotating shaft rotates.

Additional aspects and/or advantages of the invention will be set forth in part in the description which follows and, in part, will be obvious from the description, or may be learned by practice of the invention.

The above and/or other aspects are achieved by providing a variable capacity rotary compressor, including upper and lower compression chambers, a rotating shaft, upper and lower eccentric cams, upper and lower eccentric bushes, a slot, a locking pin, and a surface-treated part. The upper and lower compression chambers have different interior capacities thereof. The rotating shaft passes through the upper and lower compression chambers. The upper and lower eccentric cams are provided on the rotating shaft. The upper and lower eccentric bushes are fitted over the upper and lower eccentric cams, respectively. The slot is provided at a predetermined position between the upper and lower eccentric bushes. The locking pin operates to change a position of the upper or lower eccentric bush to a maximum eccentric position, in cooperation with the slot. The surface-treated part is provided around each of first and second ends of the slot to increase a hardness thereof, thus preventing the first and second ends of the slot from being deformed or worn out when the locking pin collides with the first and second ends of the slot.

The surface-treated part may be provided through a surface heat treatment. In particular, the surface-treated part may be provided through a high-frequency heat treatment, thus allowing a surface of the surface-treated part to have an increased hardness while preventing an elongation of an inside of the surface-treated part from being reduced.

The surface-treated part may be fabricated to have a Rockwell Hardness (HRC) of 45 or higher.

The surface-treated part may be fabricated to have a pearlite composition of 50% or more.

The inside of the surface-treated part may have an elongation of 15% or higher.

The locking pin may project from the rotating shaft between the upper and lower eccentric cams which are eccentric from the rotating shaft in a same direction, and the slot may be formed around a connecting part to engage with the locking pin. In this case, the connecting part integrally connects the upper and lower eccentric bushes, which are eccentric from the rotating shaft in opposite directions, to each other. The upper and lower eccentric bushes may be integrated with the connecting part into a single structure through a forging process or a casting process.

In the case of the casting process, the surface-treated part may be fabricated to prevent a chilled structure from being formed.

BRIEF DESCRIPTION OF THE DRAWINGS

These and/or other aspects and advantages of the invention will become apparent and more readily appreciated from the following description of the embodiment, taken in conjunction with the accompanying drawings of which.

DETAILED DESCRIPTION OF THE PREFERRED EMBODIMENT

Figure 1:
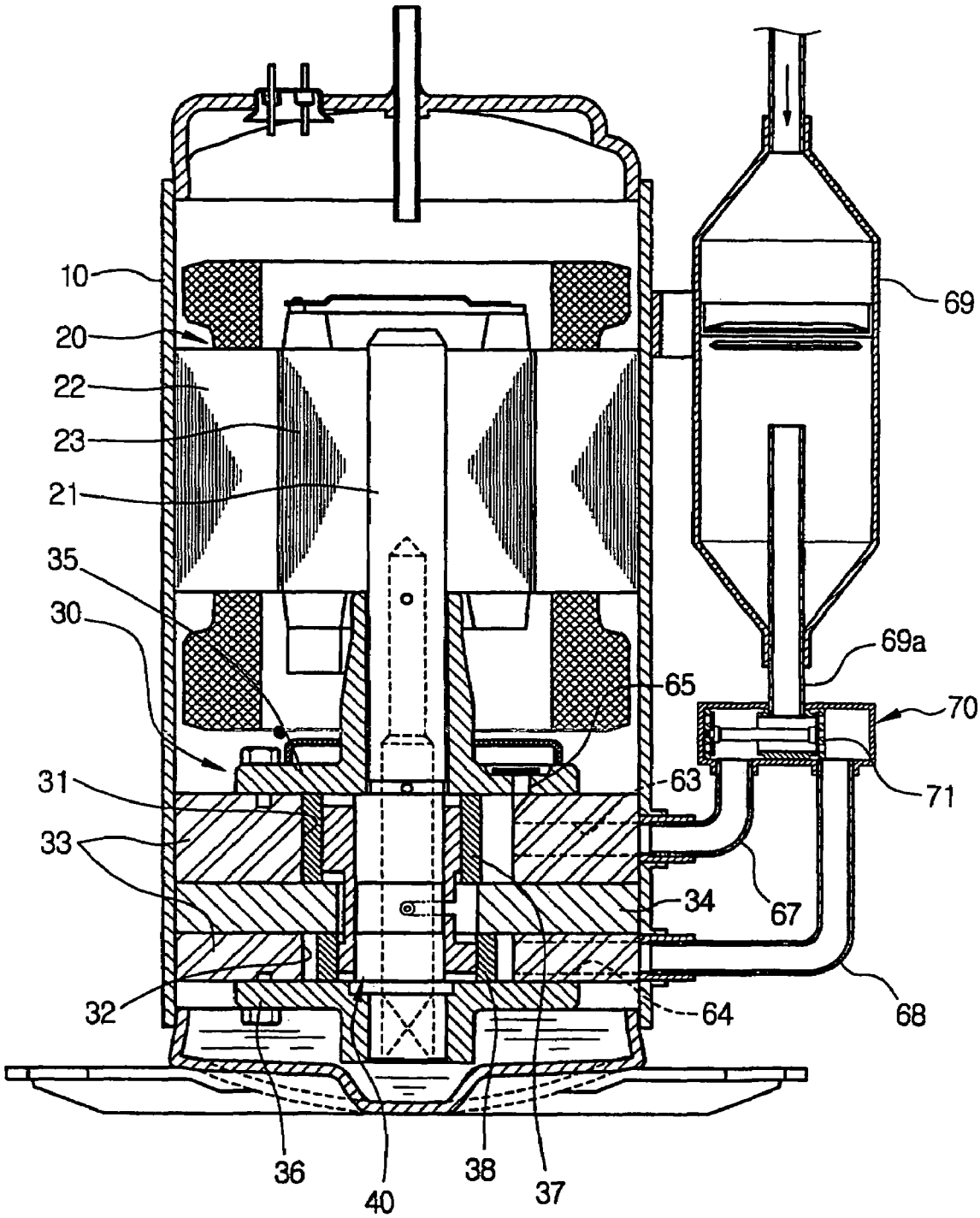
FIG. 1 is a sectional view showing an interior construction of a variable capacity rotary compressor, according to an embodiment of the present invention.

Reference will now be made in detail to the embodiment of the present invention, examples of which are illustrated in the accompanying drawings, wherein like reference numerals refer to like elements throughout.

FIG. 1 is a sectional view showing a variable capacity rotary compressor, according to an embodiment of the present invention. As illustrated in FIG. 1, the variable capacity rotary compressor includes a hermetic casing 10, with a drive unit 20 and a compressing unit 30 being installed in the hermetic casing 10. The drive unit 20 generates a rotating force, and the compressing unit 30 compresses gas using the rotating force of the drive unit 20. The drive unit 20 includes a cylindrical stator 22, a rotor 23 and a rotating shaft 21. The stator 22 fixedly is mounted to an inner surface of the hermetic casing 10. The rotor 23 is rotatably installed in the stator 22. The rotating shaft 21 is installed to pass through a center of the rotor 23, and rotates along with the rotor 23 in a first direction, which is counterclockwise in the drawings, or in a second direction, which is clockwise in the drawings.

The compressing unit 30 includes a housing 33, upper and lower flanges 35 and 36, and a partition plate 34. The housing 33 defines upper and lower compression chambers 31 and 32, which are both cylindrical but have different capacities from each other, therein. The upper and lower flanges 35 and 36 are mounted to upper and lower ends of the housing 33, respectively, to rotatably support the rotating shaft 21. The partition plate 34 is interposed between the upper and lower compression chambers 31 and 32 to partition the upper and lower compression chambers 31 and 32 from each other.

The upper compression chamber 31 may be taller (i.e., may be higher in a vertical direction) than the lower compression chamber 32, thus the upper compression chamber 31 would have a larger capacity than the lower compression chamber 32. Therefore, a larger amount of gas is compressible in the upper compression chamber 31 in comparison with the lower compression chamber 32, thus allowing the variable capacity rotary compressor to have a variable capacity.

Further, when the lower compression chamber 32 is taller than the upper compression chamber 31, the lower compression chamber 32 has a larger capacity than the upper compression chamber 31, thus allowing a larger amount of gas to be compressed in the lower compression chamber 32.

Further, an eccentric unit 40 is placed in the upper and lower compression chambers 31 and 32 to execute a compressing operation in either the upper or lower compression chamber 31 or 32, according to a rotating direction of the rotating shaft 21. A construction and operation of the eccentric unit 40 will be described later herein, with reference to FIGS. 2 to 8.

Upper and lower rollers 37 and 38 are placed in the upper and lower compression chambers 31 and 32, respectively, to be rotatably fitted over the eccentric unit 40. Upper inlet and upper outlet ports 63 and 65 (see FIG. 3) are formed at predetermined positions of the housing 33 to communicate with the upper compression chamber 31. Lower inlet and lower outlet ports 64 and 66 (see FIG. 6) are formed at predetermined positions of the housing 33 to communicate with the lower compression chamber 32.

Figure 3:
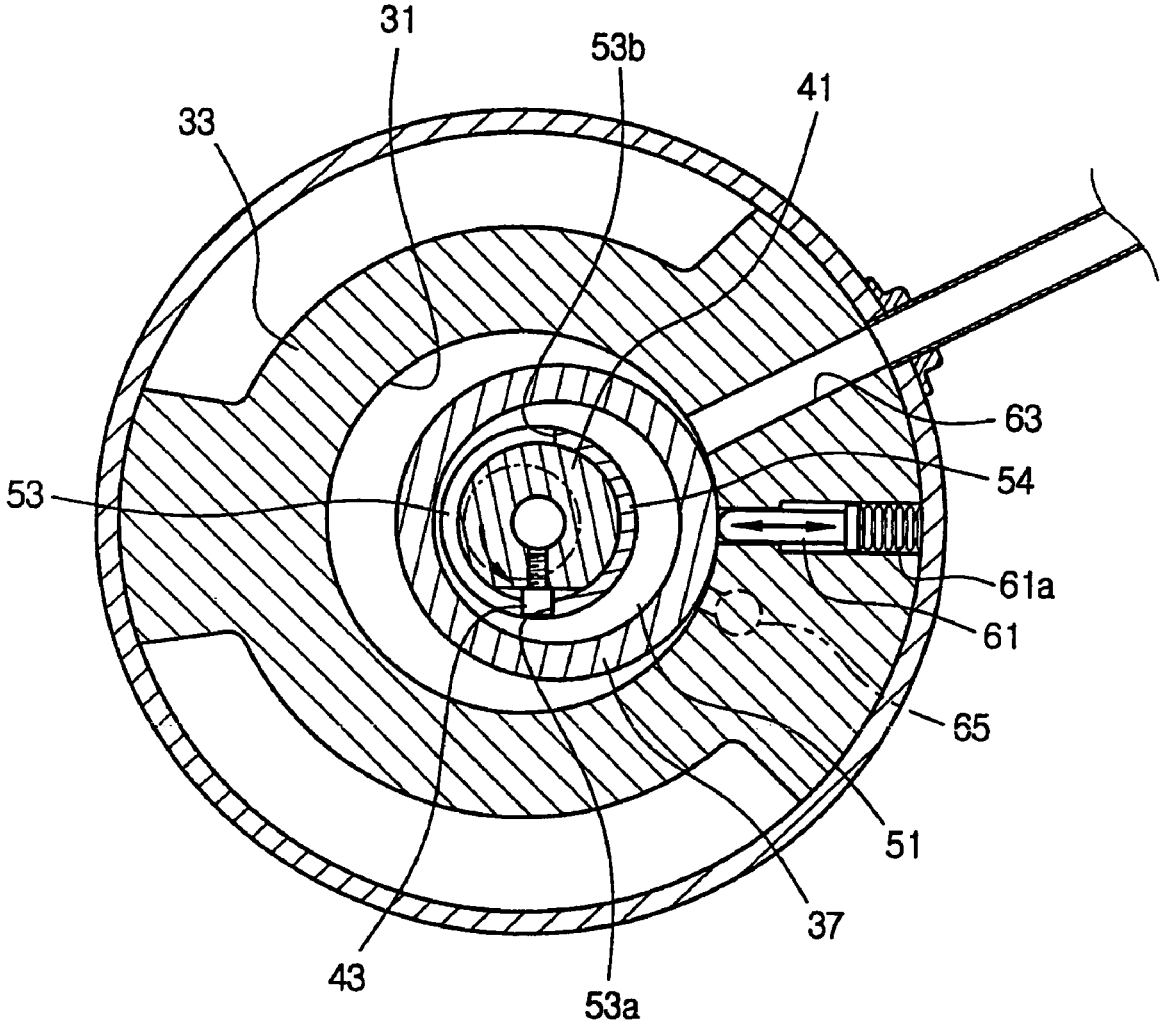
FIG. 3 is a sectional view illustrating an upper compression chamber in which a compression operation is executed by the eccentric unit of FIG. 2 when the rotating shaft rotates in a first direction.

An upper vane 61 is positioned between the upper inlet and upper outlet ports 63 and 65, and is biased in a radial direction by an upper support spring 61*a* to be in close contact with the upper roller 37 (see FIG. 3). Further, a lower vane 62 is positioned between the lower inlet and lower outlet ports 64 and 66, and is biased in the radial direction by a lower support spring 62*a* to be in close contact with the lower roller 38 (see FIG. 6).

Further, a refrigerant outlet pipe 69*a* extends from an accumulator 69 which contains a refrigerant therein. Of the refrigerant contained in the accumulator 69, only a gas refrigerant flows into the variable capacity rotary compressor through the refrigerant outlet pipe 69*a*. At a predetermined position of the refrigerant outlet pipe 69*a* is installed a path control unit 70. The path control unit 70 operates to open or to close upper or lower intake paths 67 or 68, thus supplying the gas refrigerant to the upper or lower inlet port 63 or 64 of the upper or lower compression chamber 31 or 32 in which a compression operation is executed. A valve unit 71 is installed in the path control unit 70 to be movable in a horizontal direction. The valve unit 71 operates to open either the upper or lower intake paths 67 or 68 by a difference in a pressure between the upper intake path 67 connected to the upper inlet port 63 and the lower intake path 68 connected to the lower inlet port 64, thus supplying the gas refrigerant to the upper inlet port 63 or lower inlet port 64.

A construction of the rotating shaft 21 and the eccentric unit 40 according to the embodiment of the present invention will be described in the following with reference to FIG. 2.

Figure 2:
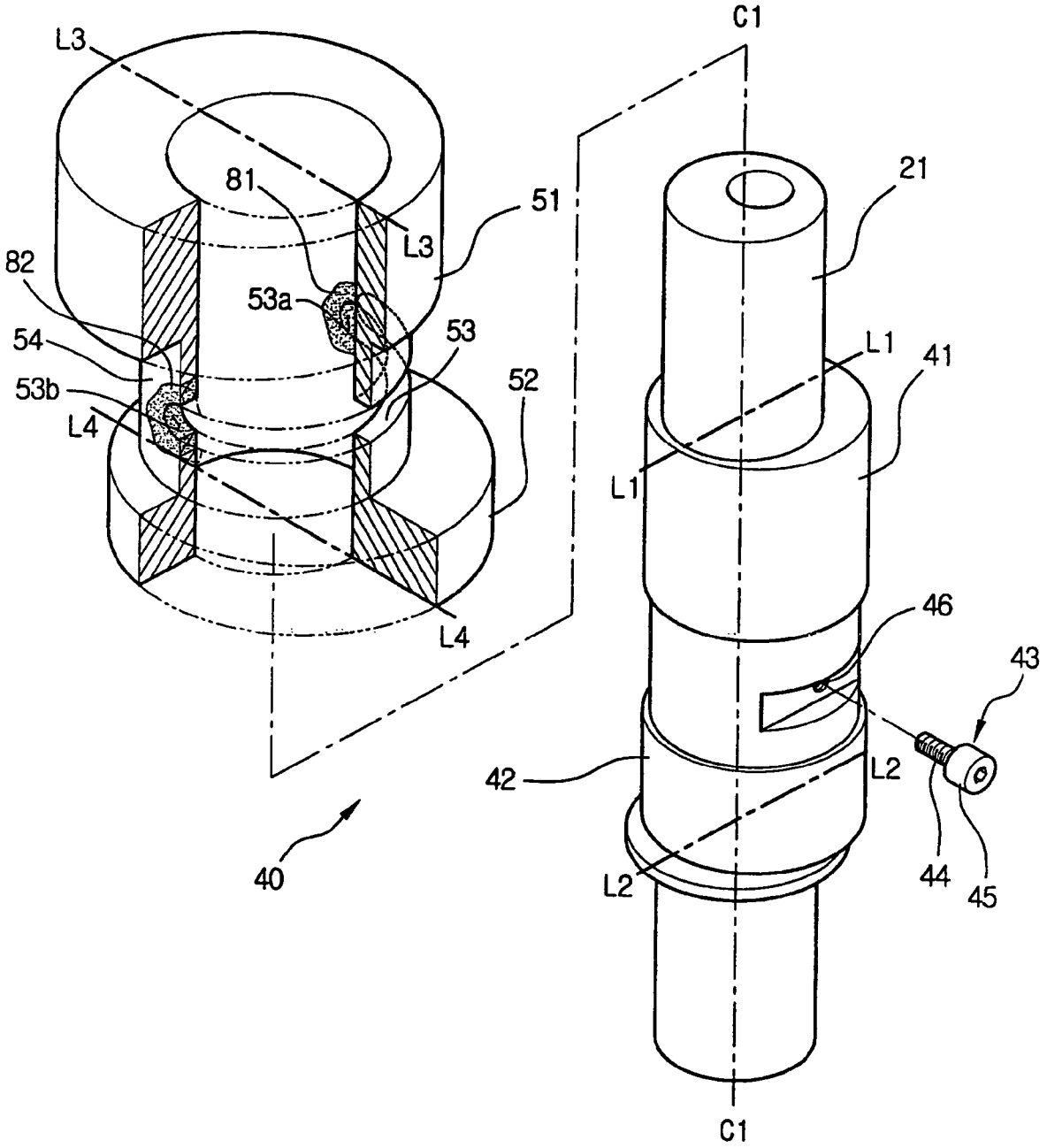
FIG. 2 is an exploded perspective view of an eccentric unit included in the variable capacity rotary compressor of FIG. 1, in which upper and lower eccentric bushes of the eccentric unit are separated from a rotating shaft.

FIG. 2 is an exploded perspective view of the eccentric unit 40 included in the variable capacity rotary compressor of FIG. 1, in which upper and lower eccentric bushes 51 and 52 of the eccentric unit 40 are separated from the rotating shaft. As illustrated in FIG. 2, the eccentric unit 40 includes upper and lower eccentric cams 41 and 42. The upper and lower eccentric cams 41 and 42 are provided on the rotating shaft 21 to be placed in the upper and lower compression chambers 31 and 32, respectively. Upper and lower eccentric bushes 51 and 52 are fitted over the upper and lower eccentric cams 41 and 42, respectively. A locking pin 43 is provided at a predetermined position between the upper and lower eccentric cams 41 and 42. A slot 53 of a predetermined length is provided at a predetermined position between the upper and lower eccentric bushes 51 and 52 to engage with the locking pin 43.

The upper and lower eccentric cams 41 and 42 integrally are fitted over the rotating shaft 21 to be eccentric from the central axis C1—C1 of the rotating shaft 21. The upper and lower eccentric cams 41 and 42 are positioned to correspond an upper eccentric line L1—L1 of the upper eccentric cam 41 to a lower eccentric line L2—L2 of the lower eccentric cam 42. In this case, the upper eccentric line L1—L1 is defined as a line to connect a maximum eccentric part of the upper eccentric cam 41, which maximally projects from the rotating shaft 21, to a minimum eccentric part of the upper eccentric cam 41, which minimally projects from the rotating shaft 21. Further, the lower eccentric line L2—L2 is defined as a line to connect a maximum eccentric part of the lower eccentric cam 42, which maximally projects from the rotating shaft 21, to a minimum eccentric part of the lower eccentric cam 42, which minimally projects from the rotating shaft 21.

The locking pin 43 includes a threaded shank 44 and a head 45. The head 45 has a slightly larger diameter than the shank 44, and is formed at an end of the shank 44. Further, a threaded hole 46 is formed on the rotating shaft 21 between the upper and lower eccentric cams 41 and 42 to be at about 90° with the maximum eccentric parts of the upper and lower eccentric cams 41 and 42. The threaded shank 44 of the locking pin 43 inserts into the threaded hole 46 in a screw-type fastening method to lock the locking pin 43 to the rotating shaft 21.

The upper and lower eccentric bushes 51 and 52 are integrated with each other by a connecting part 54 which connects the upper and lower eccentric bushes 51 and 52 to each other. The slot 53 is formed around a part of the connecting part 54, and has a width which is slightly larger than a diameter of the head 45 of the locking pin 43.

Thus, when the upper and lower eccentric bushes 51 and 52 which are integrally connected to each other by the connecting part 54 are fitted over the rotating shaft 21 and the locking pin 43 is inserted to the threaded hole 46 of the rotating shaft 21 through the slot 53, the locking pin 43 is mounted to the rotating shaft 21 while engaging with the slot 53.

When the rotating shaft 21 rotates in the first direction or the second direction in such a state, the upper and lower eccentric bushes 51 and 52 are not rotated until the locking pin 43 comes into contact with one of the first and second ends 53*a* and 53*b* of the slot 53. When the locking pin 43 comes into contact with the first or second end 53*a* or 53*b* of the slot 53, the upper and lower eccentric bushes 51 and 52 rotate in the first direction or the second direction along with the rotating shaft 21.

In this case, a first eccentric line L3—L3, which connects a maximum eccentric part of the upper eccentric bush 51 to a minimum eccentric part thereof, is placed at about 90° with a first line which connects the first end 53*a* of the slot 53 to a center of the connecting part 54. Further, a second eccentric line L4—L4, which connects a maximum eccentric part of the lower eccentric bush 52 to a minimum eccentric part thereof, is placed at about 90° with a second line which connects the second end 53*b* of the slot 53 to the center of the connecting part 54.

Further, the first eccentric line L3—L3 of the upper eccentric bush 51 and the second eccentric line L4—L4 of the lower eccentric bush 52 are positioned on a common plane, but the maximum eccentric part of the upper eccentric bush 51 is arranged to be opposite to the maximum eccentric part of the lower eccentric bush 52. An angle between a third line extending from the first end 53*a* of the slot 53 to a center of the rotating shaft 21 and a fourth line extending from the second end 53*b* of the slot 53 to the center of the rotating shaft 21 is 180°. The slot 53 is formed around a part of the connecting part 54.

Thus, when the locking pin 43 contacts the first end 53*a* of the slot 53 so that the upper eccentric bush 51 rotates along with the rotating shaft 21 in the first direction (the lower eccentric bush 52 is being rotated), the maximum eccentric part of the upper eccentric cam 41 is aligned with the maximum eccentric part of the upper eccentric bush 51. At this time, the upper eccentric bush 51 rotates in the first direction while being maximally eccentric from the central axis C1—C1 of the rotating shaft 21 (see FIG. 3). Further, in the lower compression chamber 32, the maximum eccentric part of the lower eccentric cam 42 is aligned with the minimum eccentric part of the lower eccentric bush 52. Thus, the lower eccentric bush 52 rotates in the first direction while being concentric with the central axis C1—C1 of the rotating shaft 21 (see FIG. 4).

Conversely, when the locking pin 43 contacts the second end 53*b* of the slot 53 so that the lower eccentric bush 52 rotates along with the rotating shaft 21 in the second direction, the maximum eccentric part of the lower eccentric cam 42 is aligned with the maximum eccentric part of the lower eccentric bush 52. At this time, the lower eccentric bush 52 rotates in the second direction while being maximally eccentric from the central axis C1—C1 of the rotating shaft 21 (see FIG. 6). Further, in the upper compression chamber 31, the maximum eccentric part of the upper eccentric cam 41 is aligned with the minimum eccentric part of the upper eccentric bush 51. Thus, the upper eccentric bush 51 rotates in the second direction while being concentric with the central axis C1—C1 of the rotating shaft 21 (see FIG. 7).

When the rotating shaft 21 rotates in the first or second direction, the locking pin 43 contacts the first or second end 53*a* or 53*b* of the slot 53. At this time, the locking pin 43 weakly collides with parts around the first and second ends 53*a* and 53*b* of the slot 53. Further, as will be described later herein, when the upper and lower rollers 37 and 38, respectively, pass the upper and lower vanes 61 and 62 in the upper and lower compression chambers 31 and 32, the upper and lower eccentric bushes 51 and 52 slip in a rotating direction of the rotating shaft 21. Thus, the locking pin 43 may repeatedly collide with the first and second ends 53*a* and 53*b* of the slot 53. As a result, the parts around the first and second ends 53*a* and 53*b* of the slot 53 may be worn out or deformed due to repeated impacts.

Thus, first and second surface-treated parts 81 and 82 are, respectively, provided around the first and second ends 53*a* and 53*b* of the slot 53 so that the parts around the first and second ends 53*a* and 53*b* have an increased hardness as compared to remaining parts, thus minimizing an abrasion or a deformation of the parts around the first and second ends 53*a* and 53*b*.

The upper and lower eccentric bushes 51 and 52 are assembled into a single structure by the connecting part 54. Subsequently, to increase the hardness around the first and second ends 53*a* and 53*b* of the slot 53, surfaces around the first and second ends 53*a* and 53*b* of the slot 53 are heat-treated or coated, thus forming the first and second surface-treated parts 81 and 82 having a predetermined size. The first and second surface-treated parts 81 and 82 prevent the parts around the first and second ends 53*a* and 53*b* of the slot 53 from being deformed or worn out.

A high-frequency heat treatment exists to treat only the parts around the first and second ends 53*a* and 53*b* of the slot 53, as an example of a method of forming the first and second surface-treated parts 81 and 82.

By the heat treatment, surfaces of the first and second surface-treated parts 81 and 82 have a high hardness. However, interior portions of the first and second surface-treated parts 81 and 82 are not affected by the heat treatment, thus an elongation is not reduced. Therefore, a high workability and a toughness of the upper and lower eccentric bushes 51 and 52 are maintained.

The upper and lower eccentric bushes 51 and 52, which may be provided with the first and second surface-treated parts 81 and 82 and may be integrated with each other by the connecting part 54, may be made of a material which increases a surface hardness of the upper and lower eccentric bushes 51 and 52, and maintains an excellent interior toughness and a high elongation even in a case of a surface treatment. Further, the material may be easily cast or forged for mass production, for example, the material may be selected from cast iron or steel materials.

That is, the slot 53 is formed around a part of the connecting part 54, which is integrated with the upper and lower eccentric bushes 51 and 52 and the upper and lower eccentric bushes 51 and 52 are produced through a casting process or forging process. The parts around the first and second ends 53*a* and 53*b* of the slot 53 are processed through the high-frequency heat treatment, thus forming the first and second surface-treated parts 81 and 82.

The first and second surface-treated parts 81 and 82 have a Rockwell Hardness (HRC) of 45 or higher, through the high-frequency heat treatment. In this case, metal structures of the first and second surface-treated parts 81 and 82 have a pearlite composition of 50% or more so that the first and second surface-treated parts 81 and 82 have the HRC of 45 or higher.

Further, only surfaces of the first and second surface-treated parts 81 and 82 are heat-treated so that the interior of the surface-treated parts 81 and 82 have an elongation of 15% or higher. Thus, the surfaces of the first and second surface-treated parts 81 and 82 have the high hardness while preventing a toughness of the upper and lower eccentric bushes 51 and 52 from being reduced. Therefore, the workability of the upper and lower eccentric bushes 51 and 52 is not reduced, and the upper and lower eccentric bushes 51 and 52 may tolerate repeated impacts.

Further, in the case where the upper and lower eccentric bushes 51 and 52 are produced through the casting process, the first and second surface-treated parts 81 and 82 are formed by heat-treating the surfaces of the parts around the first and second ends 53*a* and 53*b* of the slot 53 such that a chilled structure is not formed, thus preventing the workability of the upper and lower eccentric bushes 51 and 52 from being reduced at a final processing stage of the upper and lower eccentric bushes 51 and 52.

An operation of compressing a gas refrigerant in the upper or lower compression chamber 31 or 32 by the eccentric unit 40 according to the embodiment of the present invention will be described in the following with reference to FIGS. 3 to 8.

Figure 4:
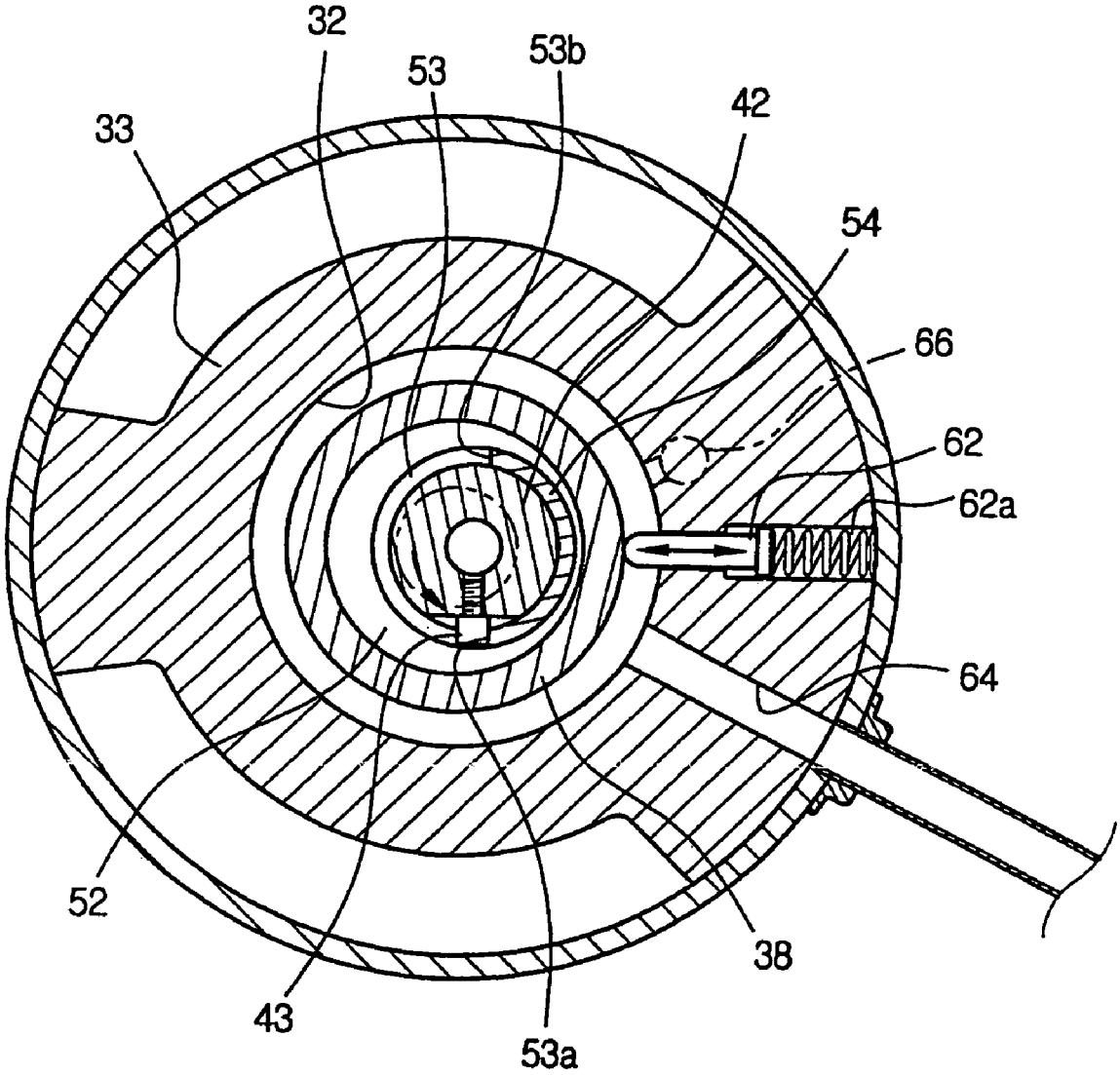
FIG. 4 is a sectional view, corresponding to FIG. 3, which shows a lower compression chamber in which an idle operation is executed by the eccentric unit of FIG. 2, when the rotating shaft rotates in the first direction.
Figure 5:
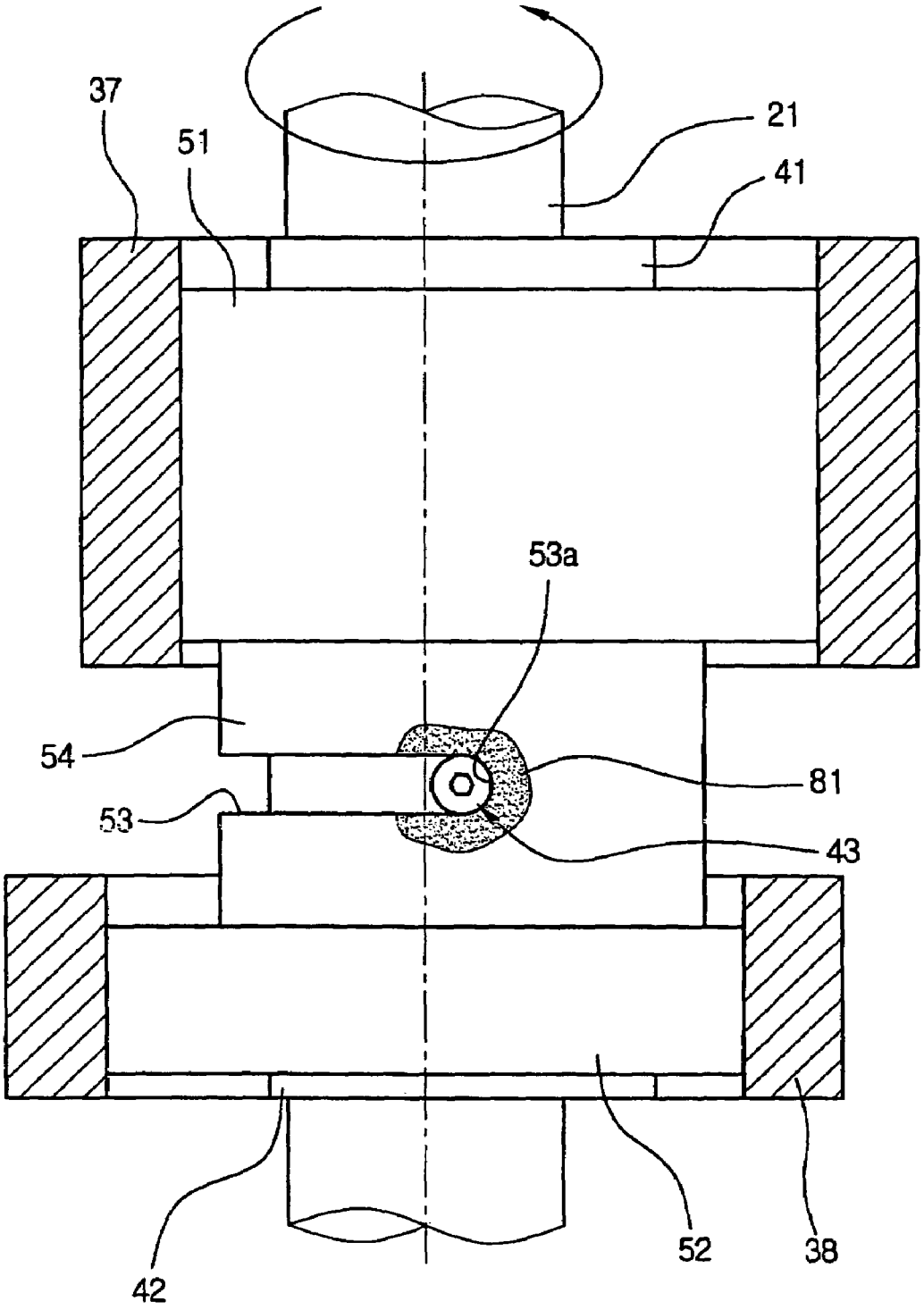
FIG. 5 is a sectional view showing a state in which a locking pin is locked by a first end of a slot to make the eccentric unit rotate along with the rotating shaft, when the rotating shaft rotates in the first direction.

FIG. 3 is a sectional view illustrating an upper compression chamber 31 in which a compression operation is executed by the eccentric unit 40 of FIG. 2 when the rotating shaft 21 rotates in a first direction. FIG. 4 is a sectional view, corresponding to FIG. 3, which shows a lower compression chamber 32 in which an idle operation is executed by the eccentric unit 40 of FIG. 2, when the rotating shaft rotates in the first direction. FIG. 5 is a sectional view showing a state in which a locking pin 43 is locked by a first end 53*a* of a slot 53 to make the eccentric unit 40 rotate along with the rotating shaft 21, when the rotating shaft 21 rotates in the first direction.

As illustrated in FIG. 3, when the rotating shaft 21 rotates in the first direction which is counterclockwise in FIG. 3, the locking pin 43 projecting from the rotating shaft 21 rotates at a predetermined angle while engaging with the slot 53 which is provided at a predetermined position between the upper and lower eccentric bushes 51 and 52. When the locking pin 43 rotates at the predetermined angle, and is locked by the first end 53*a* of the slot 53, the upper eccentric bush 51 rotates along with the rotating shaft 21.

When the locking pin 43 contacts the first end 53*a* of the slot 53, the maximum eccentric part of the upper eccentric cam 41 is aligned with the maximum eccentric part of the upper eccentric bush 51. In this case, the upper eccentric bush 51 rotates while being maximally eccentric from the central axis C1—C1 of the rotating shaft 21. Thus, the upper roller 37 rotates while being in contact with an inner surface of the housing 33 to define the upper compression chamber 31, thus executing the compression operation.

Simultaneously, as illustrated in FIG. 4, the maximum eccentric part of the lower eccentric cam 42 contacts with the minimum eccentric part of the lower eccentric bush 52. In this case, the lower eccentric bush 52 rotates while being concentric with the central axis C1—C1 of the rotating shaft 21. Thus, the lower roller 38 rotates while being spaced apart from the inner surface of the housing 33, which defines the lower compression chamber 32, by a predetermined interval, thus the compression operation is not executed and the lower compression chamber 32 otherwise executes the idle operation.

Therefore, when the rotating shaft 21 rotates in the first direction, the gas refrigerant flowing to the upper compression chamber 31 through the upper inlet port 63 is compressed by the upper roller 37 in the upper compression chamber 31 having a larger capacity, and subsequently is discharged from the upper compression chamber 31 through the upper outlet port 65. However, the compression operation is not executed in the lower compression chamber 32 having a smaller capacity. Therefore, the rotary compressor operates in a larger capacity compression mode.

Further, as shown in FIG. 3, when the maximum eccentric part of the upper eccentric bush 51 is aligned with (i.e., the upper roller 37 comes into contact with) the upper vane 61, the operation of compressing the gas refrigerant is completed and an operation of drawing the gas refrigerant starts. At this time, some of the compressed gas, which was not discharged from the upper compression chamber 31 through the upper outlet port 65, returns to the upper compression chamber 31 and is re-expanded, thus applying a pressure to the upper roller 37 and the upper eccentric bush 51 in a rotating direction of the rotating shaft 21. At this time, the upper eccentric bush 51 rotates faster than the rotating shaft 21, thus causing the upper eccentric bush 51 to slip over the upper eccentric cam 41.

When the rotating shaft 21 further rotates in such a state, the locking pin 43 collides with the first end 53*a* of the slot 53 to make the upper eccentric bush 51 rotate at a same speed as that of the rotating shaft 21. At this time, the part around the first end 53*a* of the slot 53 may be deformed or worn out.

However, the eccentric unit 40 has the first surface-treated part 81 around the first end 53*a* of the slot 53, thus having the high hardness. Therefore, even when the locking pin 43 repeatedly collides with the first end 53*a* of the slot 53, the part around the first end 53*a* is rarely deformed or worn out, thus ensuring a smooth operation of the eccentric unit 40.

Figure 6:
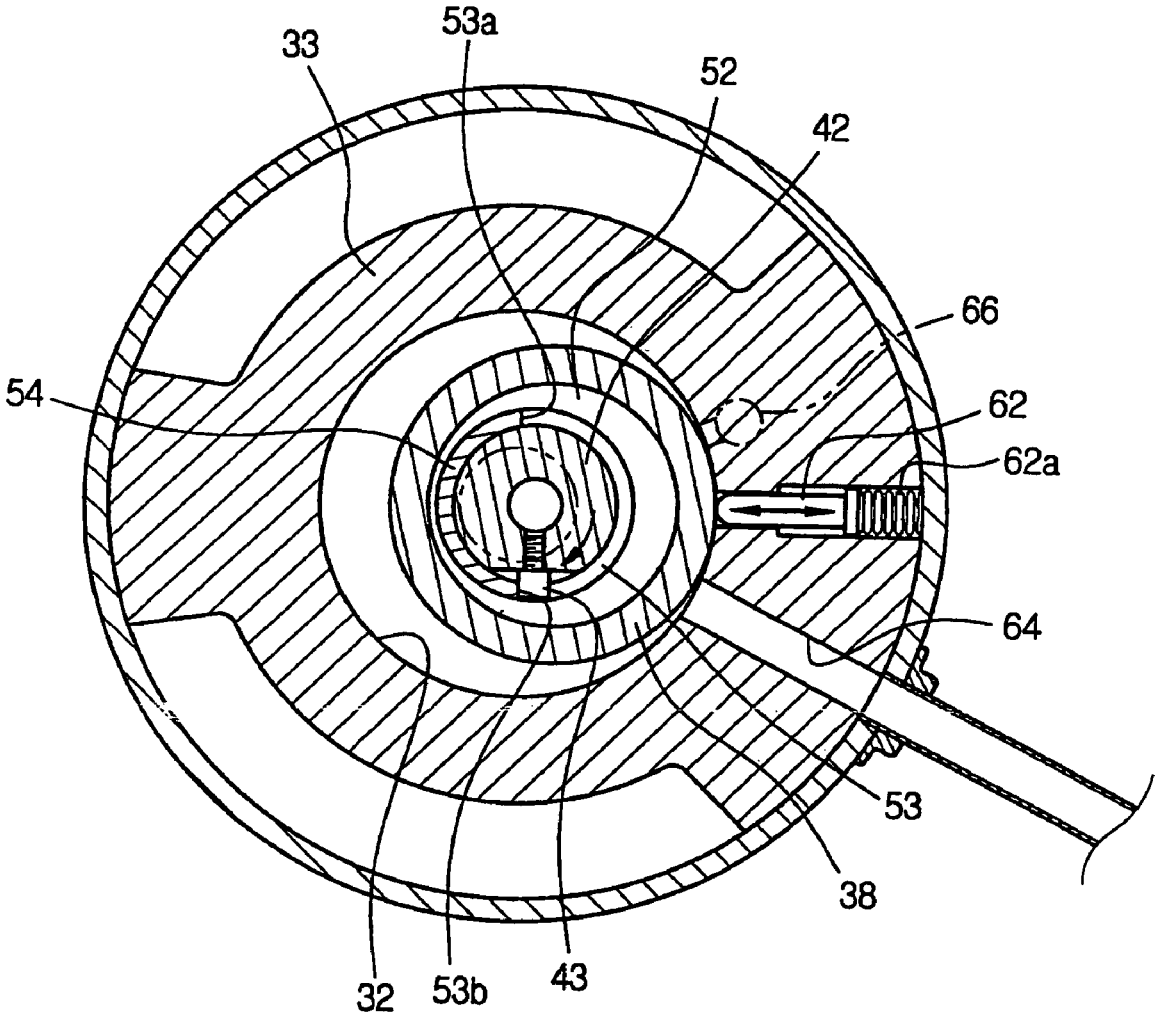
FIG. 6 is a sectional view illustrating the lower compression chamber in which the compression operation is executed by the eccentric unit of FIG. 2 when the rotating shaft rotates in a second direction.
Figure 7:
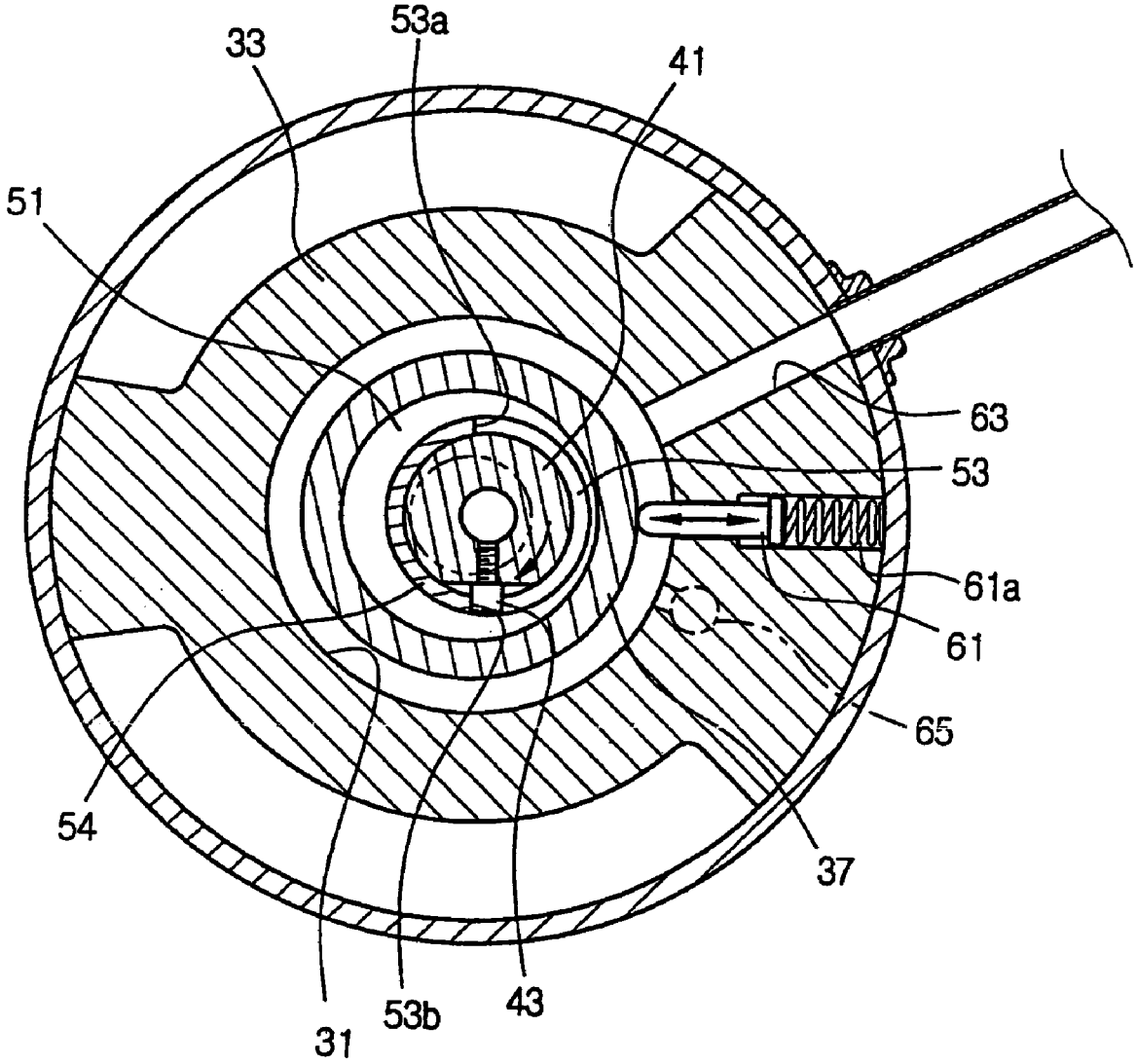
FIG. 7 is a sectional view, corresponding to FIG. 6, which shows the upper compression chamber in which the idle operation is executed by the eccentric unit of FIG. 2, when the rotating shaft rotates in the second direction.
Figure 8:
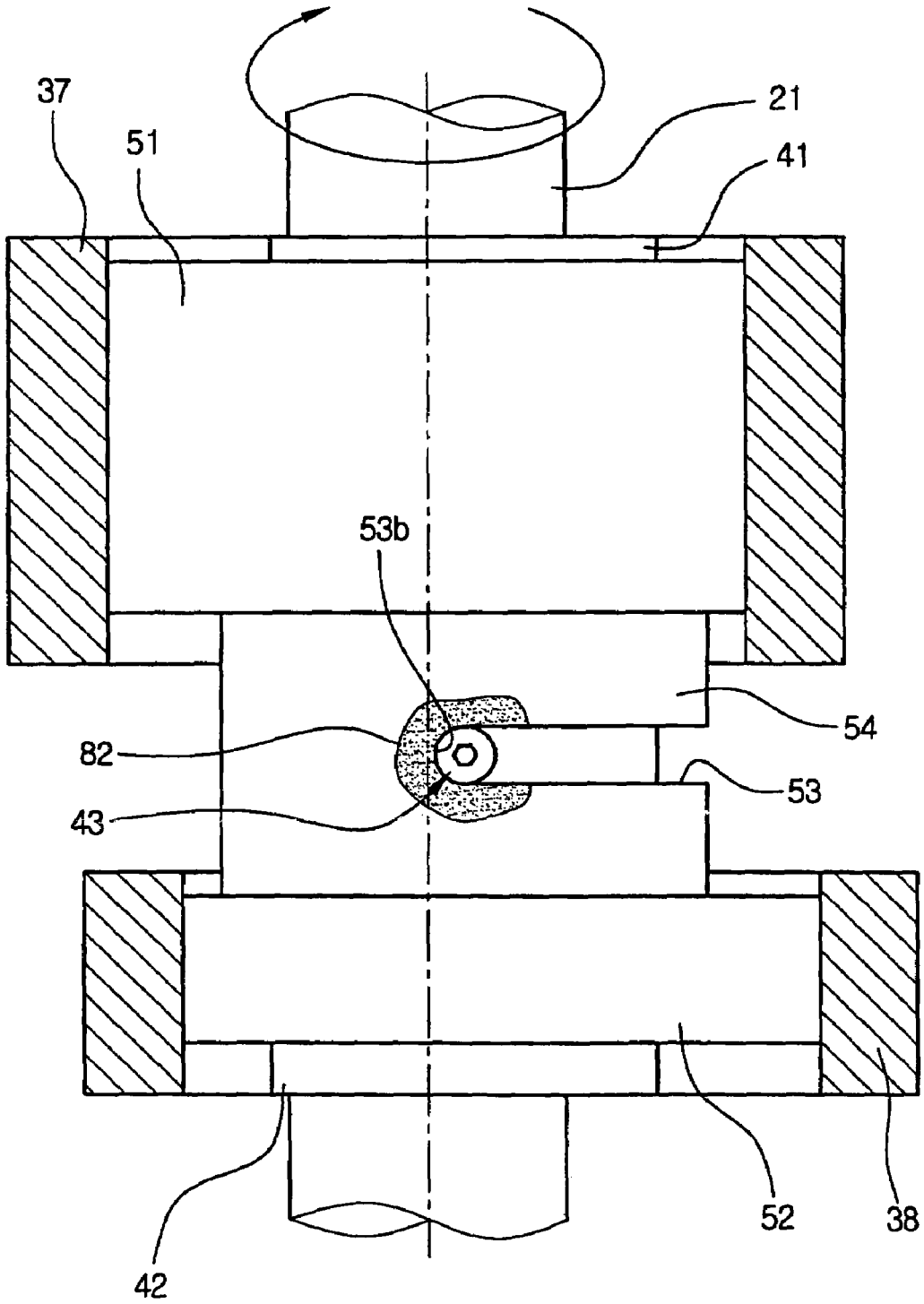
FIG. 8 is a sectional view showing a state in which the locking pin is locked by a second end of the slot to make the eccentric unit rotate along with the rotating shaft, when the rotating shaft rotates in the second direction.

FIG. 6 is a sectional view illustrating the lower compression chamber 32 in which the compression operation is executed by the eccentric unit 40 of FIG. 2 when the rotating shaft rotates in a second direction. FIG. 7 is a sectional view, corresponding to FIG. 6, which shows the upper compression chamber 31 in which the idle operation is executed by the eccentric unit 40 of FIG. 2, when the rotating shaft rotates in the second direction. FIG. 8 is a sectional view showing a state in which the locking pin 43 is locked by a second end 53*b* of a slot 53 to make the eccentric unit 40 rotate along with the rotating shaft 21, when the rotating shaft 21 rotates in the second direction.

As illustrated in FIG. 6, when the rotating shaft 21 rotates in the second direction, which is clockwise in FIG. 6, the variable capacity rotary compressor is operated oppositely to the operation shown in FIGS. 3 and 4, thus causing the compression operation to be executed in only the lower compression chamber 32.

That is, while the rotating shaft 21 rotates in the second direction, the locking pin 43 projecting from the rotating shaft 21 comes into contact with the second end 53*b* of the slot 53, thus causing the lower and upper eccentric bushes 52 and 51 to rotate in the second direction.

In this case, the maximum eccentric part of the lower eccentric cam 42 contacts the maximum eccentric part of the lower eccentric bush 52, thus the lower eccentric bush 52 rotates while being maximally eccentric from the central axis C1—C1 of the rotating shaft 21. Therefore, the lower roller 38 rotates while being in contact with the inner surface of the housing 33 which defines the lower compression chamber 32, thus executing the compression operation.

Simultaneously, as illustrated in FIG. 7, the maximum eccentric part of the upper eccentric cam 41 contacts with the minimum eccentric part of the upper eccentric bush 51. In this case, the upper eccentric bush 51 rotates while being concentric with the central axis C1—C1 of the rotating shaft 21. Thus, the upper roller 37 rotates while being spaced apart from the inner surface of the housing 33, which defines the upper compression chamber 31, by a predetermined interval, thus the compression operation is not executed and the upper compression chamber 31 otherwise executes the idle operation.

Therefore, the gas refrigerant flowing to the lower compression chamber 32 through the lower inlet port 64 is compressed by the lower roller 38 in the lower compression chamber 32 having a smaller capacity, and subsequently is discharged from the lower compression chamber 32 through the lower outlet port 66. However, the compression operation is not executed in the upper compression chamber 31 having a larger capacity. Therefore, the rotary compressor is operated in a smaller capacity compression mode.

Further, as shown in FIG. 6, when the maximum eccentric part of the lower eccentric bush 52 is aligned with (i.e., the lower roller 38 comes into contact with) the lower vane 62, the operation of compressing the gas refrigerant is completed and an operation of drawing the gas refrigerant starts. At this time, some of the compressed gas, which was not discharged from the lower compression chamber 32 through the lower outlet port 66, returns to the lower compression chamber 32 and is re-expanded, thus applying a pressure to the lower roller 38 and the lower eccentric bush 52 in the rotating direction of the rotating shaft 21. At this time, the lower eccentric bush 52 rotates faster than the rotating shaft 21, thus causing the lower eccentric bush 52 to slip over the lower eccentric cam 42.

When the rotating shaft 21 further rotates in such a state, the locking pin 43 collides with the second end 53*b* of the slot 53 to make the lower eccentric bush 52 rotate at a same speed as that of the rotating shaft 21. At this time, the part around the second end 53*b* of the slot 53 may be deformed or worn out.

However, the eccentric unit 40 has the second surface-treated part 82 around the second end 53*b* of the slot 53, similarly to the first surface-treated part 81 provided around the first end 53*a* of the slot 53, thus having the high hardness. Therefore, even when the locking pin 43 repeatedly collides with the second end 53*b* of the slot 53, the part around the second end 53*b* is rarely deformed or worn out, thus ensuring a smooth operation of the eccentric unit 40.

As is apparent from the above description, a variable capacity rotary compressor is provided, which is designed to execute a compression operation in either of upper and lower compression chambers having different interior capacities thereof by an eccentric unit which rotates in a first direction or a second direction, thus varying a compression capacity of the variable capacity rotary compressor as desired.

Further, a variable capacity rotary compressor is provided, which has first and second surface-treated parts around first and second ends of a slot, respectively, to provide the parts around the first and second ends of the slot with a high hardness, thus the parts around the first and second ends of the slot are rarely deformed or worn out, although a locking pin repeatedly collides with the first or second end of the slot when an upper bush or a lower eccentric bush slips due to a variance in a pressure of an upper or lower compression chamber as an eccentric unit rotates in a first direction or a second direction, therefore ensuring a smooth operation of the upper and lower eccentric bushes.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A variable capacity rotary compressor, comprising:

upper and lower compression chambers having different interior capacities thereof;

a rotating shaft passing through the upper and lower compression chambers;

upper and lower eccentric cams provided on the rotating shaft;

upper and lower eccentric bushes fitted over the upper and lower eccentric cams, respectively;

a slot provided at a predetermined position between the upper and lower eccentric bushes;

a locking pin to change a position of the upper or lower eccentric bush to a maximum eccentric position, in cooperation with the slot; and a surface-treated part provided around each of first and second ends of the slot to increase a hardness thereof to prevent the first and second ends of the slot from being deformed or worn out when the locking pin collides with the first and second ends of the slot.

2. The rotary compressor according to claim 1, wherein the surface-treated part is provided through a localized heat treatment.

3. The rotary compressor according to claim 2, wherein the surface-treated part is provided through a high-frequency heat treatment to allow a surface of the surface-treated part to have the increased hardness while preventing an elongation of an interior of the surface-treated part from being reduced.

4. The rotary compressor according to claim 2, wherein the surface-treated part is fabricated to have a Rockwell Hardness of 45 or higher.

5. The rotary compressor according to claim 2, wherein the surface-treated part is fabricated to have a pearlite composition of 50% or more.

6. The rotary compressor according to claim 2, wherein an interior of the surface-treated part has an elongation of 15% or higher.

7. The rotary compressor according to claim 1, further comprising:

a connecting part integrally connecting the upper and lower eccentric bushes, which are eccentric from the rotating shaft in opposite directions, to each other, wherein the locking pin projects from the rotating shaft between the upper and lower eccentric cams which are eccentric from the rotating shaft in a common direction, and the slot is formed around the connecting part to engage with the locking pin.

8. The rotary compressor according to claim 7, wherein the upper and lower eccentric bushes are integrated with the connecting part into a single structure through a forging process.

9. The rotary compressor according to claim 8, wherein the surface-treated part is provided through a localized heat treatment to allow a surface of the surface-treated part to have a Rockwell Hardness of 45 or higher while allowing an interior of the surface-treated part to have an elongation of 15% or higher.

10. The rotary compressor according to claim 9, wherein the surface-treated part is fabricated to have a pearlite composition of 50% or more.

11. The rotary compressor according to claim 7, wherein the upper and lower eccentric bushes are integrated with the connecting part into a single structure through a casting process.

12. The rotary compressor according to claim 11, wherein the surface-treated part is provided through a localized heat treatment to allow a surface of the surface-treated part to have a Rockwell Hardness of 45 or higher and an interior of the surface-treated part to have an elongation of 15% or higher.

13. The rotary compressor according to claim 12, wherein the surface-treated part is fabricated to prevent a chilled structure from being formed.

14. A variable capacity rotary compressor, comprising:

upper and lower compression chambers having different interior capacities thereof;

a rotating shaft passing through the upper and lower compression chambers;

upper and lower eccentric cams mounted to the rotating shaft to be placed in the upper and lower compression chambers, respectively, the upper and lower eccentric cams being eccentric from the rotating shaft in a common direction;

upper and lower eccentric bushes fitted over the upper and lower eccentric cams, respectively, to be eccentric from the rotating shaft in opposite directions;

a slot provided around a connecting part which connects the upper and lower eccentric bushes to each other;

a locking pin projecting from the rotating shaft between the upper and lower eccentric cams and to engage with the slot, the locking pin operating to change a position of the upper eccentric bush or the lower eccentric bush to a maximum eccentric position according to a rotating direction of the rotating shaft; and a surface-treated part provided around each of first and second ends of the slot to increase a hardness thereof to prevent the first and second ends of the slot from being deformed or worn out when the locking pin collides with the first and second ends of the slot.

15. The rotary compressor according to claim 14, wherein the upper and lower eccentric bushes are integrated with the connecting part into a single structure through a forging process.

16. The rotary compressor according to claim 15, wherein the surface-treated part is provided through a localized heat treatment to allow a surface of the surface-treated part to have a Rockwell Hardness of 45 or higher and an interior of the surface-treated part to have an elongation of 15% or higher.

17. The rotary compressor according to claim 16, wherein the surface-treated part is fabricated to have a pearlite composition of 50% or more.

18. The rotary compressor according to claim 14, wherein the upper and lower eccentric bushes are integrated with the connecting part into a single structure through a casting process.

19. The rotary compressor according to claim 18, wherein the surface-treated part is provided through a localized heat treatment to allow a surface of the surface-treated part to have a Rockwell hardness of 45 or higher and an interior of the surface-treated part to have an elongation of 15% or higher.

20. The rotary compressor according to claim 19, wherein the surface-treated part is fabricated to prevent a chilled structure from being formed.

21. The rotary compressor according to claim 16, wherein the surface-treated part is made of one of cast iron and steel.

22. A variable capacity rotary compressor having upper and lower compression chambers, comprising:

upper and lower eccentric cams rotatably provided in the upper and lower compression chambers, respectively;

upper and lower eccentric bushes fitted over the upper and lower eccentric cams, respectively;

a slot formed between the upper and lower eccentric bushes, and having first and second ends;

a locking pin movable within the slot to configure the upper and lower eccentric bushes to provide a compression operation in one of the upper and lower compression chambers and to provide an idle operation in a remaining one of the upper and lower compression chambers; and a surface-treated part provided around each of the first and second ends of the slot to increase a hardness thereof to prevent the first and second ends of the slot from being deformed or worn out when the locking pin collides with the first and second ends of the slot.

23. The rotary compressor according to claim 22, wherein the upper and lower eccentric bushes are not rotated until the locking pin comes into contact with one of the first and second ends of the slot and when the locking pin contacts with the first or second end of the slot, the upper and lower eccentric bushes rotates in a first direction or a second direction according to which one of the first and second ends is contacted by the locking pin.

24. A variable capacity rotary compressor having upper and lower compression chambers, comprising:

a slot having first and second ends;

a locking pin movable between the first and second ends, and upper and lower eccentric bushes provided in the upper and lower compression chambers, respectively, and changeably configurable such that a compression operation is provided in one of the upper and lower compression chambers and an idle operation is provided in a remaining one of the upper and lower compression chambers according to a position of the locking pin; and a surface-treated part provided around each of the first and second ends of the slot to prevent the first and second ends of the slot from being deformed or worn out when the locking pin collides with the first and second ends of the slot.

* * * * *

UNITED STATES PATENT AND TRADEMARK OFFICE

CERTIFICATE OF CORRECTION

PATENT NO. : 7,070,395 B2
APPLICATION NO. : 10/832348
DATED : July 4, 2006
INVENTOR(S) : In Ju Lee et al.

It is certified that error appears in the above-identified patent and that said Letters Patent is hereby corrected as shown below:

Column 12, Line 50, change “Rockwell hardness” to --Rockwell Hardness--.

Signed and Sealed this

Twenty-third Day of January, 2007

JON W. DUDAS
*Director of the United States Patent and Trademark Office*